US010586523B1

(12) United States Patent
Kohler et al.

(10) Patent No.: US 10,586,523 B1
(45) Date of Patent: Mar. 10, 2020

(54) HEARING DEVICE WITH ACTIVE NOISE CONTROL BASED ON WIND NOISE

(71) Applicant: Sonova AG, Stafa (CH)

(72) Inventors: Simon Kohler, Hinwil (CH); Antonio Maria Modesto Holzl, Zurich (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/369,901

(22) Filed: Mar. 29, 2019

(51) Int. Cl.
*G10K 11/178* (2006.01)
*H04R 1/08* (2006.01)

(52) U.S. Cl.
CPC ..... *G10K 11/17854* (2018.01); *H04R 1/08* (2013.01); *G10K 2210/1081* (2013.01); *G10K 2210/3026* (2013.01); *G10K 2210/3027* (2013.01); *H04R 2410/07* (2013.01)

(58) Field of Classification Search
CPC ..... G10K 11/17854; G10K 2210/1081; G10K 2210/3026; G10K 2210/3027; H04R 1/08; H04R 2410/07
See application file for complete search history.

(56) References Cited

U.S. PATENT DOCUMENTS 8,019,103 B2 * 9/2011 Kates ..... H04R 25/502 381/317
8,073,150 B2 12/2011 Joho et al.
8,073,151 B2 12/2011 Joho et al.
8,208,650 B2 6/2012 Joho et al.
9,123,320 B2 9/2015 Carreras et al.
9,456,286 B2 9/2016 Kuhnel et al.
2007/0086598 A1 4/2007 De Callafon
2017/0148428 A1 5/2017 Thuy et al.
2018/0249266 A1 * 8/2018 Termeulen ..... H04R 29/001
2019/0069074 A1 * 2/2019 Yamkovoy ..... H04R 1/1083

FOREIGN PATENT DOCUMENTS

CN 105052170 A 11/2015
DE 10 2010 012 941 A1 4/2011
EP 1339256 A2 8/2003
EP 1519626 A2 3/2005
EP 2642481 A1 9/2013
WO 2010/129241 A1 11/2010

* cited by examiner

*Primary Examiner* — Andrew L Sniezek
(74) *Attorney, Agent, or Firm* — Pearne & Gordon LLP

(57) ABSTRACT

A method for operating a hearing device including a component to be worn at least partially in an ear of a user and an active noise control (ANC) system is provided. The method includes capturing an audio with a microphone system, generating an audio signal based on the captured audio, and generating a feed-forward (FF) compensating signal based on the captured audio. The method includes monitoring the acoustic environment of the hearing device for presence of wind noise, and mixing the audio signal with the generated FF compensating signal at a ratio dependent on whether wind noise is detected to provide an acoustic output signal. A hearing device including an active noise control (ANC) system and a wind noise monitor is also provided.

21 Claims, 6 Drawing Sheets

HEARING DEVICE WITH ACTIVE NOISE CONTROL BASED ON WIND NOISE

FIELD OF INVENTION

The following description relates generally to a method for operating a hearing device, as well as to a hearing device adapted to perform the method. More specifically, the following description relates to a method for, and a hearing device adapted to perform, an active noise control in a windy environment.

BACKGROUND OF INVENTION

In the field of hearing-aid devices, noise cancelling is an important issue because background noise interferes with the desired signal (processed audio from outer microphones or streaming signals, such as a telephone call or music, for example). One known way of cancelling noise in a signal including a desired signal and an unwanted signal (i.e., noise signal or unprocessed ambient sound leaking into the ear canal) uses an active noise control (ANC), also known as active noise cancellation or active noise reduction (ANR). Active noise control (ANC) can be used to reduce unwanted sound by adding a noise-countering sound specifically designed to cancel unwanted noise. Windy environments, however, can challenge the ANC system and may not only interfere with the noise reduction, but may even amplify the wind noise.

SUMMARY

The present invention provides a hearing device that includes an active noise control (ANC) system and a method for operating such hearing device.

In one general aspect, the method for operating a hearing device with an active noise control (ANC) system may include capturing audio with a microphone system and generating an audio signal based on the captured audio. The method may further include generating a feed-forward (FF) compensating signal based on the captured audio. The method may further include monitoring an acoustic environment of the hearing device for presence of wind noise. The method may include mixing the audio signal with the generated FF compensating signal at a ratio of the generated FF compensating signal dependent on whether wind noise is detected to provide an acoustic output signal.

In another general aspect, the ratio of the mixing of the generated FF compensating signal with the audio signal may be set by adjusting an output level of the generated FF compensating signal or by weighting the mixing of the generated FF compensating signal relative to the audio signal.

In another general aspect, the output level of the generated FF compensating signal may be set to zero or the weighting of the generated FF compensating signal may be set to zero.

In another general aspect, the ratio of the mixing of the generated FF compensating signal with the audio signal may be set by reducing the output level of the generated FF compensating signal.

In another general aspect, the ratio of the mixing of the generated FF compensating signal with the audio signal may be set by weighting the mixing of the generated FF compensating signal in proportion to the detected wind noise, a desired ambient noise reduction, and a desired wind noise reduction.

In another general aspect, mixing the audio signal with the generated FF compensating signal may include giving the generated FF compensating signal a lower weight than the audio signal when wind is detected.

In another general aspect, the audio signal may be mixed with the reduced output level of the FF compensating signal when wind is detected.

In another general aspect, the method for operating a hearing device with an active noise control (ANC) system may further include capturing an ear-canal noise and generating an ear-canal noise signal with an ear-canal microphone, generating a feed-back (FB) compensating signal based on the ear-canal noise signal; and mixing the audio signal with the generated FB compensating signal to provide an acoustic output signal.

In another general aspect, the FB compensating signal may be continuously generated when the output level of the generated FF compensating signal is adjusted or when weighting the mixing of the generated FF compensating signal relative to the audio signal.

In another general aspect, the ambient noise microphone may be arranged outside an ear canal of the user.

In another general aspect, the ear-canal microphone may be configured to be arranged inside an ear canal of the user.

In another general aspect, the adjusting the output level of the generated FF compensating signal may include substantially reducing the output level of the FF compensating signal.

In another general aspect, the adjusting the output level of the generated FF compensating signal may include reducing the output level of the FF compensating signal below a predetermined threshold.

In another general aspect, the adjusting the output level of the generated FF compensating signal may include substantially turning off the FF compensating signal.

In another general aspect, the adjusting the output level of the generated FF compensating signal may include turning off the FF compensating signal.

In another general aspect, the generating the FF compensating signal may include adaptive filtering, with filter parameters for the adaptive filtering being adjusted based on the audio signal.

In another general aspect, the generating the FB compensating signal may include adaptive filtering, with filter parameters for the adaptive filtering being adjusted based on the ear-canal noise signal.

In another general aspect, the microphone system may include a first microphone configured to capture a first audio and generate a first audio signal and a second microphone configured to capture a second audio and generate a second audio signal. The monitoring the acoustic environment of the hearing device for presence of wind noise may include determining a level of the wind noise based on a coherence between the first audio signal and the second audio signal.

In another general aspect, a level of the coherence between the first audio signal and the second audio signal may be determined between corresponding sub-bands of the first audio signal and the second audio signal.

In another general aspect, the monitoring the acoustic environment of the hearing device for presence of wind noise may include monitoring a ratio between energy levels in low frequency bands and a total signal energy of the audio signal and the ear-canal noise signal.

In another general aspect, a hearing device may include a microphone system configured to capture audio, a signal processor configured to generate an audio signal based on the captured audio; an active noise control (ANC) system configured to generate a feed-forward (FF) compensating signal based on the captured audio; a wind noise monitor configured to monitor an acoustic environment of the hearing device for presence of wind noise; and a mixer configured to mix the audio signal with the generated FF compensating signal at a ratio of the generated FF compensating signal dependent on whether wind noise is detected to provide an acoustic output signal.

In another general aspect, the ratio of the mixing of the generated FF compensating signal with the audio signal may be set by adjusting an output level of the generated FF compensating signal or by weighting the mixing of the generated FF compensating signal relative to the audio signal.

In another general aspect, the output level of the generated FF compensating signal may be set to zero or the weighting of the generated FF compensating signal may be set to zero.

In another general aspect, the ratio of the mixing of the generated FF compensating signal with the audio signal may be set by reducing the output level of the generated FF compensating signal.

In another general aspect, the ratio of the mixing of the generated FF compensating signal with the audio signal may be set by weighting the mixing of the generated FF compensating signal in proportion to the detected wind noise, a desired ambient noise reduction, and a desired wind noise reduction.

In another general aspect, mixing the audio signal with the generated FF compensating signal may include giving the generated FF compensating signal a lower weight than the audio signal when wind is detected.

In another general aspect, the audio signal may be mixed with the reduced output level of the FF compensating signal when wind is detected.

In another general aspect, the hearing device may further include an ear-canal microphone configured to capture an ear-canal noise and generate an ear-canal noise signal. The ANC system may be further configured to generate a feed-back (FB) compensating signal based on the ear-canal noise signal. The mixer may be further configured to mix the audio signal with the generated FB compensating signal to provide an acoustic output signal.

In another general aspect, the ANC system may be configured to continuously generate the FB compensating signal when the output level of the generated FF compensating signal is adjusted or when weighting the mixing of the generated FF compensating signal relative to the audio signal.

In another general aspect, the microphone system may be arranged outside an ear canal of the user.

In another general aspect, the ear-canal microphone may be configured to be arranged inside an ear canal of the user.

In another general aspect, the active noise control (ANC) system may be further configured to adjust the output level of the generated FF compensating signal by substantially reducing the output level of the generated FF compensating signal when wind noise is detected.

In another general aspect, the active noise control (ANC) system may be configured to adjust the output level of the generated FF compensating signal by reducing the output level of the generated FF compensating signal below a predetermined threshold when wind noise is detected.

In another general aspect, the active noise control (ANC) system may be configured to adjust the output level of the generated FF compensating signal by substantially turning off the FF compensating signal when wind noise is detected.

In another general aspect, the active noise control (ANC) system may be configured to adjust the output level of the generated FF compensating signal by turning off the FF compensating signal when wind noise is detected.

In another general aspect, wherein the active noise control (ANC) system may include at least one adaptive filter, with filter parameters for the at least one adaptive filter being adjusted based on the audio signal.

In another general aspect, the active noise control (ANC) system may include at least one adaptive filter, with filter parameters for the at least one adaptive filter being adjusted based on the ear-canal noise signal.

In another general aspect, the microphone system of the hearing device may include a first microphone configured to capture a first audio and generate a first audio signal and a second microphone configured to capture a second audio and generate a second audio signal. The wind noise monitor may be further configured to determine a level of the wind noise based on a coherence between the first audio signal and the second audio signal.

In another general aspect, a level of the coherence between the first audio signal and the second audio signal may be determined between corresponding sub-bands of the first audio signal and the second audio signal.

In another general aspect, the wind noise monitor may be further configured to determine a level of the wind noise based on a ratio between energy levels in low frequency bands and a total signal energy of the audio signal and the ear-canal noise signal.

In another general aspect, the method for operating a hearing device with an active noise control (ANC) system may include capturing audio with a microphone system and generating an audio signal representing the captured audio. The method may further include generating a feed-forward (FF) compensating signal based on the audio signal. The method may further include capturing an ear-canal noise with an ear-canal microphone and generating an ear-canal noise signal representing the ear-canal noise. The method may include generating a feed-back (FB) compensating signal based on the ear-canal noise signal. The method may further include mixing the audio signal with the generated FF compensating signal and the generated FB compensating signal to provide an acoustic output signal. The method may include monitoring an acoustic environment of the hearing device with the microphone system for presence of wind noise. The method may include turning off the FF compensating signal when wind is detected. The method may further include mixing the audio signal with the generated FB compensating signal to provide an acoustic output signal.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
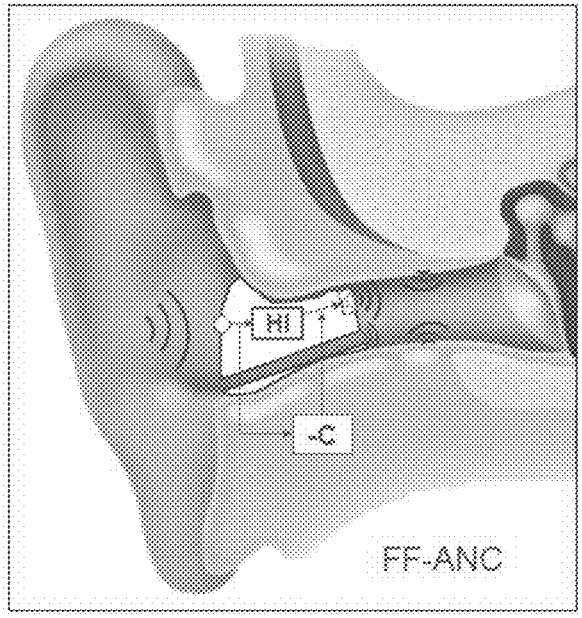
FIG. 1 is a schematic diagram illustrating the principle of feed-forward ANC.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

Within the context of the following description, hearing devices (such as hearing aids, hearing prostheses, cochlear implants, earphones, etc.) are specifically utilized by individuals to hear audio from another device or from the user's surroundings and may be used, for example in order to compensate hearing loss and/or improve hearing ability. A pair of hearing devices, one intended to be worn at the left and the other at the right ear of the user, which are linked to one another is referred to as a binaural hearing system. Different styles of hearing devices exist in the form of behind-the-ear (BTE), in-the-ear (ITE), completely-in-canal (CIC) types, as well as hybrid designs consisting of an outside-the-ear part and an in-the-ear part, the latter typically including a receiver (i.e., a miniature loudspeaker), therefore commonly termed receiver-in-the-ear (RITE) or canal-receiver-technology (CRT) hearing devices. Depending on the severity and/or cause of the user's hearing loss, other electro-mechanical output transducers, such as a bone-anchored vibrator, a direct acoustic cochlear simulator (DACS) or cochlear implant (CI) can be employed instead of a receiver. Other uses of hearing devices pertain to augmenting the hearing of normal hearing persons, for instance by means of noise suppression, to the provision of audio signals originating from remote sources, e.g., within the context of audio communication, and for hearing protection.

In hearing aids, which beside transducers for receiving an audio input include means for receiving a non-audio input signal, e.g., a RF receiver, a telecoil for receiving magnetically transmitted signals, etc., there is a possibility of losing the information transmitted and received as a non-audio signal due to disturbance from the surrounding audio environment (e.g., noise). Active Noise Cancelling (ANC) headsets, as opposed to headsets or ear plugs employing passive noise reduction, are attractive to consumers because they offer a superior listening experience in conditions that are normally hostile to audio reproduction, such as trains, airplanes and busy urban areas.

In a hearing device (e.g., ear piece) with active noise control (ANC) functionality, there are two mechanisms to actively reduce noise based on the superposition of an undesired signal with a phase inverted version (i.e., an anti-noise signal that is out of phase with the undesired noise signal). The first mechanism is a feed-forward (FF) ANC in which a microphone outside the ear canal (e.g., located in the concha) senses the noise. Such FF ANC mechanism is schematically illustrated in FIG. 1.

In an FF ANC mechanism, the linear transfer function that represents the primary path from the outer microphone to the ear canal is known or calibrated. Typically, it mainly describes the acoustic path through a defined vent. Using this transfer function, the outer microphone signal can be matched in magnitude, inversed in phase, and played back through the loudspeaker in the ear canal. This phase-inversed signal can be added to the noise signal that enters the ear canal directly from outside. As a result, the noise signal can be reduced by the superposition of the two signals. With FF-ANC, the locations where the noise signal is sensed and reduced are different. The FF ANC mechanism can improve the intelligibility of speech by cancelling ambient noise before it reaches the ear canal of the user. Higher frequencies can help to improve speech intelligibility when making phone calls, for example.

Figure 2:
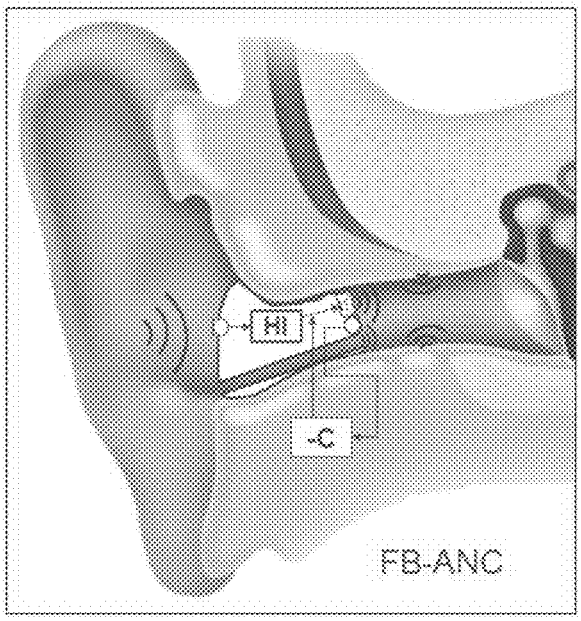
FIG. 2 is a schematic diagram illustrating the principle of feed-back ANC.

The second mechanism is a feed-back (FB) ANC, which is schematically illustrated in FIG. 2. In the feed-back (FB) ANC topology, a microphone inside the ear canal (e.g., located at the inner part of the ear piece next to the speaker) senses the noise. The signal is played back from the loudspeaker with an inversed phase, which also results in noise reduction. With FB-ANC, the location where the noise signal is sensed and reduced is the same. Feedback systems usually have better performance at low frequencies (<100 Hz) and do not reach the bandwidth of feed-forward systems. Feed-back systems can work up to 1 kHz and have a more flat ANC distribution with lower peak values. In turn, feed-forward systems show superior peak performances (typically up to 25 dB) with a cone-shaped characteristic.

In the hearing device described herein, both FF-ANC and FB-ANC run at the same time (so-called hybrid ANC). The performance of both mechanisms improves the overall ANC performance of the system. The hybrid ANC technology combines the advantages of the FF-ANC and FB-ANC systems. In some embodiments, it achieves ANC performance levels (>30 dB) and widest bandwidth by having one ANC system compensate for the drawbacks of the other ANC system. The hybrid ANC systems can achieve superior ANC performance from 20 Hz up to 3 kHz, which is not possible with a standalone feed-forward or feedback ANC system.

Hearing aids which amplify the ambient sound are sensitive to air flow turbulence at the microphone sound inlet port. This phenomenon is known as wind noise and can generate high sound pressure levels at the system input, which translate into high output levels at the ear of the user. Wind noise masks useful signals, such as speech for example, can interfere with the desired audio output, and can be annoyingly loud. Wind noise may reach magnitudes of 100 dB SPL (Sound Pressure Level) and higher. It is desirable that the wind noise level be reduced. Low-level wind noise (for example <50 dB SPL) can be attenuated by a set amount (e.g., an amount between 6 dB and 12 dB), for example. Low-level wind noise can be attenuated by using an ANC system or by other methods, for example. On a broadband level, the reduction due to ANC is typically in the range of 10 dB to 15 dB, and is independent from the intensity of wind noise level.

Windy environments can also challenge the ANC system of the earphones. Due to its turbulent nature, wind has usually a low spatial coherence. As a result, the sound pressure difference between two locations cannot be described by a linear and time-variant system (LTI). Because the location of the microphone and the vent is different (and there could also be other additional leakage paths), the known/calibrated transfer function from the concha microphone to the ear canal, which is used by the FF-ANC system, may no longer be valid when wind noise is present. As a result, FF-ANC cannot reduce or may even amplify the wind noise. For example, wind noise spectra were measured at the ear simulator microphone of a dummy head with an earphone device running in different ANC modes. Measurements were performed at 5 m/s and for different horizontal wind directions. The performed measurements indicate that, for many wind directions, FF-ANC has almost no effect (e.g., there is no difference between "ANC off" and "FF ANC"). For some wind directions, such as 30° c. and 60° c., for example, FF-ANC can even result in higher wind noise levels compared to the measurements with FF-ANC off. However, the performed measurements indicate that FB-ANC performance is not compromised by wind noise. This means that significant wind noise reduction can be achieved by using only FB-ANC or reduced FF-ANC.

Accordingly, a method to operate a hearing device with active noise reduction technology in a windy environment can take advantage of the wind noise reduction when FB-ANC is active by continuously monitoring the acoustic environment for the presence of wind noise and situationally reducing or switching off the FF-ANC if wind noise is detected.

Switching off the FF-ANC if wind is detected can prevent amplification of wind noise due to the negative effects of the FF-ANC system. In this embodiment, FB-ANC is not switched off because its noise reduction performance is not affected by the turbulent nature of the wind. As described above with respect to performed measurements of wind noise spectra, measured levels of noise with FF-ANC activated seem to always be higher or at least equal to the measured levels of noise with FF-ANC deactivated. For certain wind directions at 5 m/s wind speed, the typical amplification of wind noise due to FF-ANC is in the range of 3 to 6 dB.

Figure 3:
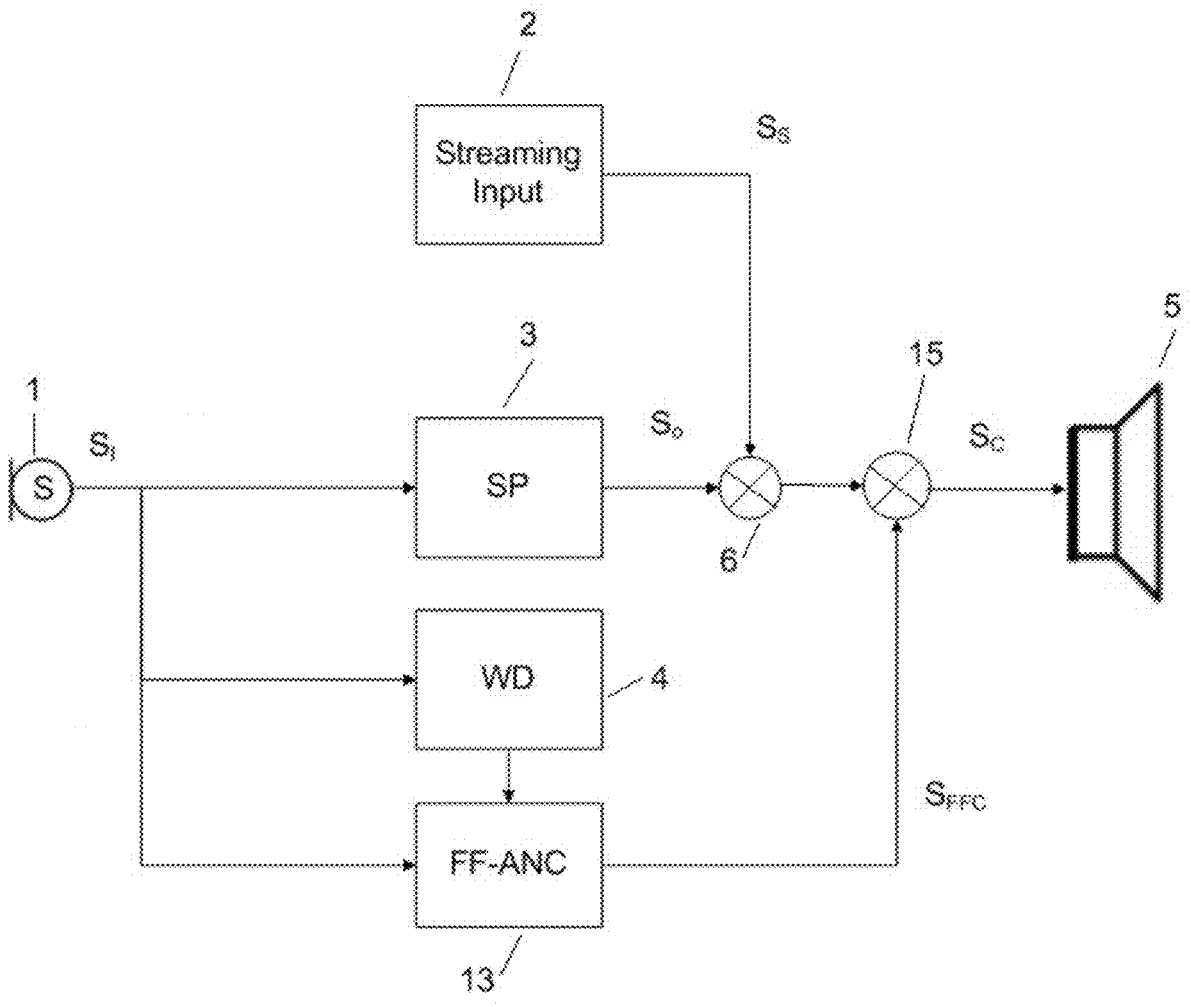
FIG. 3 is a schematic diagram of a feed-forward ANC system configured to adapt to windy environments.

A schematic diagram of an example hearing device with an FF-ANC system configured to adapt to windy environments is illustrated in FIG. 3. As shown in FIG. 3, the hearing device can include an input microphone system 1 configured to capture an audio signal and convert the audio signal into an electrical input signal $S_I$. Although the microphone system includes only one input microphone 1 in FIG. 3, the microphone system can include either a single microphone or more than one input microphone and possibly other components for various reasons, some of which are described below. In addition to the input microphone 1, further receiving means for receiving signals may be present, such as a telecoil receiver, a receiving unit including an antenna for receiving wirelessly transmitted signals, etc. For example, a streamed audio input signal $S_S$ (such as a phone call or music) can be received from a streaming input source 2 by a wired or wireless connection. The electrical input signal $S_I$ obtained from the input microphone 1 can be processed by a signal processor 3 to obtain an electrical output signal $S_O$. A desired electrical input signal can be the electrical input signal $S_I$ obtained by the input microphone 1, the streamed audio input signal $S_S$, or a mix of both input signals. The electrical output signal $S_O$ can be converted into an acoustic output signal by a receiver 5 and can be emitted into the remaining volume 7 between the user's eardrum and the in-the-ear-canal-component of the hearing device. The audio signal captured by the microphone system 1 can include a desired component and an undesired component, both of which may be included in the electrical input signal $S_I$. The undesired component ("noise component") may be ambient noise that compromises the quality of the desired component. The hearing device can further include an ANC circuitry 13 that can be configured to reduce the undesired component of the electrical signal and to provide the functionality of FF-ANC. The hearing device can further include a wind noise detector ("WD") 4 configured to determine a wind noise level present at the input microphone 1. Output from the wind noise detector ("WD") 4 can be provided to both the signal processor 3 and the ANC circuitry (e.g., compensation controller) 13, thereby situationally adapting the ANC circuitry 13 to provide and/or adjust the functionality of FF-ANC based on the detected wind noise level.

The input microphone 1 of the feed-forward ANC (FF ANC) topology circuit illustrated in FIG. 3 is arranged outside the ear canal (e.g., is located in the concha) and exposed to the exterior of the hearing device. The input microphone 1 is configured to sense and receive the audio signal, and convert the audio signal into the electrical input signal $S_I$. As further illustrated in FIG. 3, the electrical input signal $S_I$ obtained from the input microphone 1 is fed to an auxiliary input of a compensation controller 13 where the noise component of the electrical input signal $S_I$ is processed by the compensation controller 13. For example, the compensation controller 13 can filter the noise component of the electrical input signal $S_I$, invert the noise component of the electrical input signal $S_I$ by generating a secondary wave with compressions and rarefactions equal in amplitude and 180 degree out of phase with the noise component of the electrical input signal $S_I$, and then amplify the inverted signal $S_{FFC}$. The amplified inverted signal $S_{FFC}$ can then be mixed at a mixer 15 (or summer) with the electrical output signal $S_O$ output by the signal processor 3, and the resulting compensated signal $S_C$ can be applied to the speaker 5 which can broadcast the resulting compensated signal $S_C$ into the ear canal, thereby substantially canceling the noise from the input microphone 1 before it reaches the ear canal of the user.

In certain embodiments, an additional mixer 6 or summer can be added to the circuit illustrated in FIG. 3 to add the signals received from the signal processor 3 to the signals received from an external device, such as the streaming input source 2 or a communications network, for example.

Figure 4:
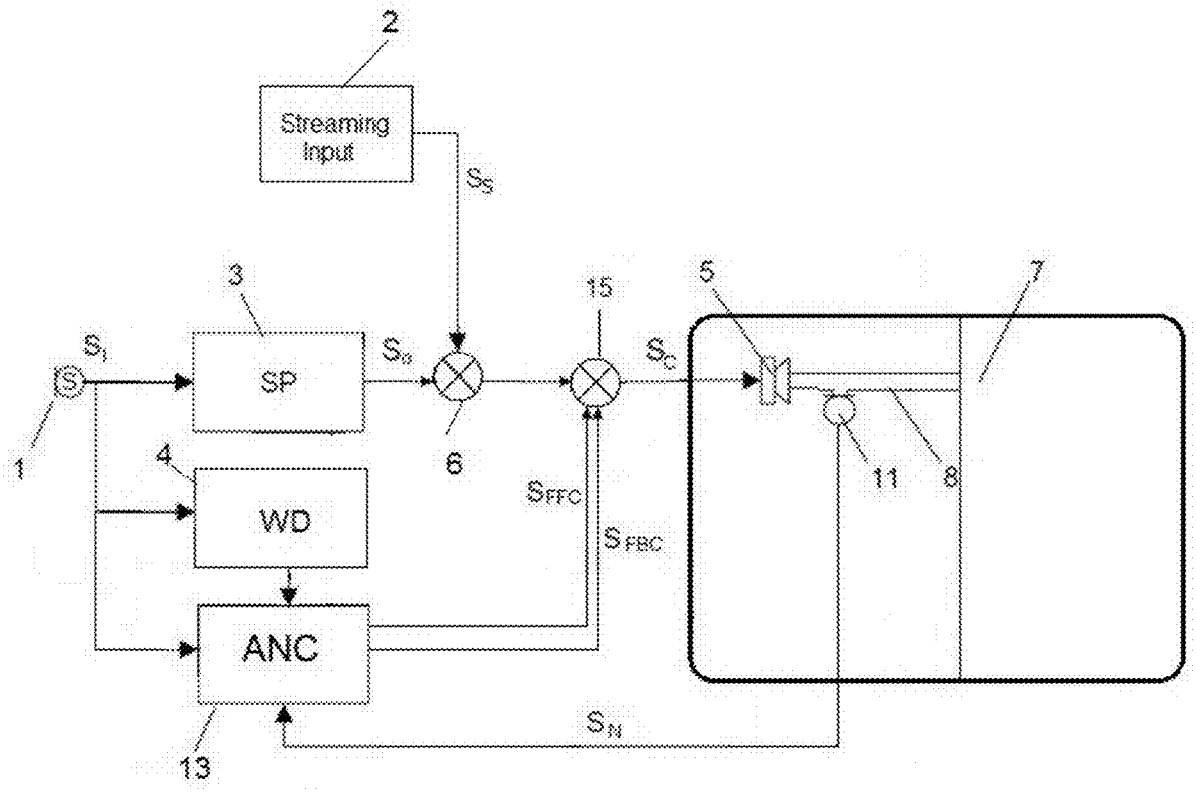
FIG. 4 is an example hearing device with a hybrid feed-forward ANC and feed-back ANC system, and a wind noise detection module.

An example hearing device with a hybrid FF ANC and feed-back ANC (FB ANC) system is illustrated in FIG. 4. For brevity purposes, only the FB ANC system will be described with reference to FIG. 4. The FB ANC topology circuit can use the same components as the ones described above for the feed-forward ANC circuit shown in FIG. 3. The main difference is the location of a noise microphone 11, which is arranged inside the ear capsule. As illustrated in FIG. 4, the hearing device can include a duct 8 that may be formed between the remaining volume 7 between the user's eardrum and the in-the-ear-canal-component of the hearing device, and the surrounding atmosphere. The duct 8 may be a vent of the in-the-ear-canal-component or it may be formed by the ear canal itself in the case of an open fitting. The receiver 5 can be configured to emit a compensation signal into the vent 8. The noise microphone 11 can be arranged inside the ear canal (e.g., can be located at the inner part of the ear piece next to the receiver 5) and configured to convert an acoustic signal in the portion of the vent 8, which is irradiated acoustically by the receiver 5, into an electrical noise signal $S_N$. A compensation signal (or feed-back canceling signal) $S_{FBC}$ that is fed to the receiver 5 can be obtained from the compensation controller 13 which can calculate the compensation signal from the electrical output signal $S_O$. The electrical noise signal $S_N$ obtained from the noise microphone 11 can be fed to an auxiliary input of the compensation controller 13, where it can be processed by the compensation controller 13. For example, the compensation controller 13 can filter the received electrical noise signal $S_N$, invert the received electrical noise signal $S_N$ by generating a secondary wave with compressions and rarefactions equal in amplitude and 180 degree out of phase with the received electrical noise signal $S_N$, and then amplify the inverted signal $S_{FBC}$. The amplified inverted signal $S_{FBC}$ can be applied to the receiver 5 which can broadcast the compensation signal into the vent 8.

The signal processor 3 may be a single digital signal processor or may be made up of different, potentially distributed processor units, preferably including at least one digital signal processor unit. The signal processor 3 can include one or more of a microprocessor, a microcontroller, a digital signal processor (DSP), an application specific integrated circuit (ASIC), a field-programmable gate array (FPGA), discrete logic circuitry, or the like. The signal processor 3 can further include memory and may store tables with predetermined values, ranges, and thresholds, as well as program instructions that cause the signal processor 3 to access the memory, execute the program instructions, and provide the functionality ascribed to it herein. The memory may include one or more volatile, non-volatile, magnetic, optical, or electrical media, such as read-only memory (ROM), random access memory (RAM), electrically-erasable programmable ROM (EEPROM), flash memory, or the like. The signal processor 3 can further include one or more analog-to-digital (A/D) and digital-to-analog (D/A) converters for converting various analog inputs to the signal processor 3, such as analog input from the input and/or noise microphones 1 and 11, for example, in digital signals and for converting various digital outputs from the signal processor 3 to analog signals representing audible sound data which can be applied to the speaker 5, for example.

The compensation controller 13 may be integrated with the signal processor 3 in a common unit, such as a digital signal processor, for example, which can potentially include analog signal processing and/or amplifying means. As an alternative, the compensation controller 13 may be a separate signal processor. The compensation controller 13 can include the functionality of an adaptive filter, for example. Signal processing parameters, such as filter coefficients of the adaptive filter, frequency-dependent gain settings, and parameters of the input sound data, etc., for example, can be adjusted based on the signals captured by the input microphone 1 and the noise microphone 11. Signal processing parameters, such as filter coefficients of the adaptive filter, for example can be stored in the memory of the signal processor 3 or in a separate memory of the compensation controller 13, if the compensation controller 13 is provided as a separate signal processor. These signal processing parameters can be used by the signal processor 3 or by the compensation controller 13, if the compensation controller 13 is provided as a separate signal processor, to activate the feed-forward or feed-back ANC compensation circuit, or to adjust the feed-forward and feed-back ANC compensation signals, for example. The input signal of the adaptive filter can be the hearing device's desired electrical output signal $S_O$ shown in FIG. 3 and FIG. 4. The electrical output signal $S_O$ can be filtered with a simulation of the error path and can used, together with the electrical input signal $S_I$ and the electrical noise signal $S_N$ of the input microphone 1 and the noise microphone 11, respectively, as an input for the adaptation of the filter coefficients. Alternative implementations of the compensation controller 13 based on principles other than adaptive filtering are possible.

Alternatively, a signal processing structure can be adjusted based on the signal recorded by the input microphone 1 and the noise microphone 11. As examples of different signal processing structures, the compensation signal may be switched off if the desired signal is below a certain level, or different filtering methods may be chosen depending on the nature and/or dynamics of the incident acoustic signal, such as when wind noise is present, for example. These different signal processing structures can be stored in the memory of the signal processor 3 or in a separate memory of the compensation controller 13, if the compensation controller 13 is provided as a separate signal processor.

In some embodiments, the compensation controller 13 can be configured to make an adjustment to the feed-forward ANC compensation signal in response to receiving an external control signal that may be provided by another component coupled to the compensation controller 13, such as the wind detecting circuitry described herein, for example.

As described above with reference to FIG. 4, the hearing device includes a wind noise detector ("WD") 4 configured to determine a wind noise level present at the input microphone 1. Wind noise can be detected and wind noise level can be estimated by various methods, some of which are described in U.S. Pat. No. 9,456,286 and European patents EP 1 339 256 A2 and EP 1 519 626 A2, for example, the entire contents of which are incorporated herein by reference. Briefly, wind noise can be detected based on a signal from a single microphone or by using two microphones, for example. Noise caused by air moving past the microphone or microphones, that is "wind", can have a characteristic noise pattern or can reach an amplitude above a certain threshold such that the noise is deemed "wind noise". For example, wind noise can be detected based on comparing a value of a cross-correlation function against a predetermined threshold. If that value is lower than the threshold, wind noise is detected. Otherwise, the noise from wind can be assumed to be of very low amplitude or practically absent and, therefore, not deemed to be "wind noise".

One method for detecting wind noise compares the output signals of two microphones. For example, European patents EP 1 339 256 A2 and EP 1 519 626 A2 describe using frequency cues and/or correlation features between two microphone signals of a hearing device. A low correlation/coherence of the output signals of the two microphones can be an indicator of presence of wind noise.

Other implementations exploit features of a beamformed signal to detect wind noise. One such implementation is described in U.S. Pat. No. 9,456,286, which relates to a binaural hearing system with two hearing devices. Signals from two microphones that are part of each hearing device are provided to a processor where beamforming is applied that results in a single beamformed signal. The resulting beamformed signal is then applied to a wind noise estimation unit to determine the wind noise levels present at the two hearing devices.

Figure 5:
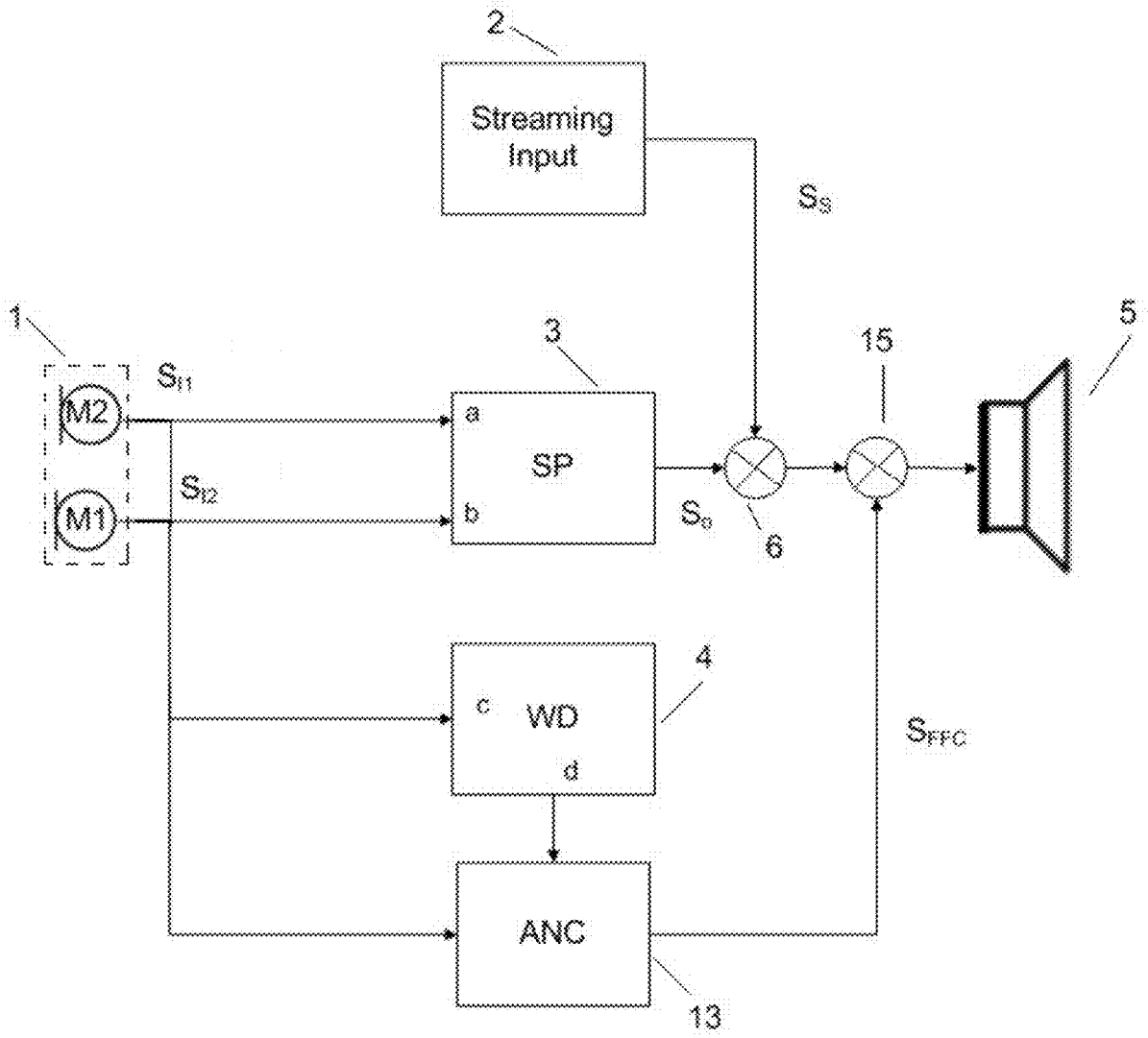
FIG. 5 is a block diagram of a hearing device with a feed-forward ANC system and an exemplary wind noise detection module.

In certain embodiments, as illustrated in FIG. 5, for example, the microphone system 1 can include a pair of microphones M1 and M2. The microphones M1 and M2 may be spaced at a certain distance apart from each other to allow for an energy level difference between them. The signal from the microphone M1 can be applied to the wind noise detector ("WD") 4 to determine a wind noise level present at the hearing device. Wind noise estimation can, for example, be based on the amount of low frequency energy detected in the signal from the microphone M1. Alternatively, a Bayesian statistical estimation scheme may be used where the probability ratio between the probability that there is wind and the probability of a windless condition is computed. For the latter purpose, it is assumed that both conditions (i.e., wind vs. no wind) arise with a Gaussian probability distribution having the same variance but different mean values. Both training data and fine tuning can be used to estimate beforehand the variance and the two mean values in order to achieve an appropriate estimation of the wind noise level.

In certain embodiments, the microphone system including two microphones can be the outer microphone 1 and an inner microphone, such as the ear-canal microphone 11, shown in FIG. 4, for example. The outer microphone 1 and the ear-canal microphone 11 may be spaced at a certain distance apart from each other to allow for an energy level difference between them. The signal from the outer microphone 1 can be applied to the wind noise detector ("WD") 4 to determine a wind noise level present at the hearing device. Wind noise estimation can, for example, be based on the amount of low frequency energy detected in the signal from the outer microphone 1.

Alternatively, the signals from the two microphones M1 and M2 can first be provided to the signal processor 3 (via the inputs a, b) where beamforming can be applied, which can result in a single beamformed signal. The beamformed signal can then be applied to the wind noise detector ("WD") 4 to determine the wind noise level present at the hearing device.

Wind noise can be detected by monitoring the coherence between the two microphones M1 and M2, for example. An omnidirectional signal, for example, from the microphone M1 as well as the beamformed signal (from the signal processor 3) can both be applied to the wind noise detector ("WD") 4, after which the wind noise detector ("WD") 4 can determine the coherence between the two signals, thus yielding a measure of the wind noise level.

In certain embodiments, a level of coherence may be determined between corresponding sub-bands of the two microphones M1 and M2. If there is a significant energy level difference, in particular in lower frequency sub-bands, the microphone acoustic signal sub-band with a higher energy level may likely have wind noise. When one of multiple microphone acoustic signals is characterized as having wind noise present, the sub-band containing the wind noise or the entire frame of the acoustic signal containing the wind noise may be discarded for the frame. The wind noise detection may include detection based on two-channel features (such as coherence) and independent one-channel detection, to decide which subset of the set of the microphones M1 and M2 is contaminated with wind noise.

For example, acoustic signals received from the microphone M1 and the microphone M2 can be converted to electrical signals, which can be processed through a frequency analysis circuit that may be part of the signal processor 3 shown in FIG. 5, for example. The frequency analysis circuit can receive acoustic signals and may mimic the frequency analysis of the cochlea (e.g., cochlea domain), simulated by a filter bank. The frequency analysis circuit can separate each of the acoustic signals from the microphones M1 and M2 into two or more frequency sub-band signals. The frequency analysis circuit may generate cochlea domain frequency sub-bands or frequency sub-bands in other frequency domains, for example sub-bands that cover a larger range of frequencies. A sub-band signal can be the result of a filtering operation of an input signal, where the bandwidth of the filter is narrower than the bandwidth of the signal received by the frequency analysis circuit. The filter bank may be implemented by a series of cascaded, complex-valued, first-order Infinite Impulse Response (IIR) filters. Alternatively, other filters such as the short-time Fourier transform (STFT), sub-band filter banks, modulated complex lapped transforms, cochlear models, wavelets, etc., can be used for the frequency analysis and synthesis. The samples of the frequency sub-band signals may be grouped sequentially into time frames (e.g., over a predetermined period of time), such as 4 ms, 8 ms, or some other length of time, for example. The sub-band frame signals can be provided from the frequency analysis circuit to a feature extraction circuit. The feature extraction circuit can compute frame energy estimations of the sub-band signals and inter-microphone level differences (ILD) between the acoustic signals from the microphones M1 and M2. The calculated frame energy estimations can be used by the wind noise detector ("WD") 4 to determine whether the acoustic signals from the microphones M1 and M2 include wind noise.

In yet another alternative, the presence of wind noise can be detected using only the outer microphone 1. Methods using a single outer microphone consider several wind noise properties, such as high magnitudes, low auto-correlation, and energy content at very low frequencies. One such method is disclosed in EP 1339256 A2, for example. For example, the presence of wind noise can be detected by monitoring the ratio between low-frequency energy and high-frequency energy of the output signal from the outer microphone 1.

Referring back to FIG. 5, regardless what method of wind noise detection or estimation may be used by the wind noise detector ("WD") 4, the determined wind noise level can be sent from the wind noise detector ("WD") 4 to the ANC circuitry 13. The determined wind noise presence or level can be used by the ANC circuitry 13 to selectively provide and/or adjust the feed-forward (FF) compensating signal $S_{FFC}$ of the ANC circuitry 13 based on the detected wind presence and/or wind noise level.

Figure 6:
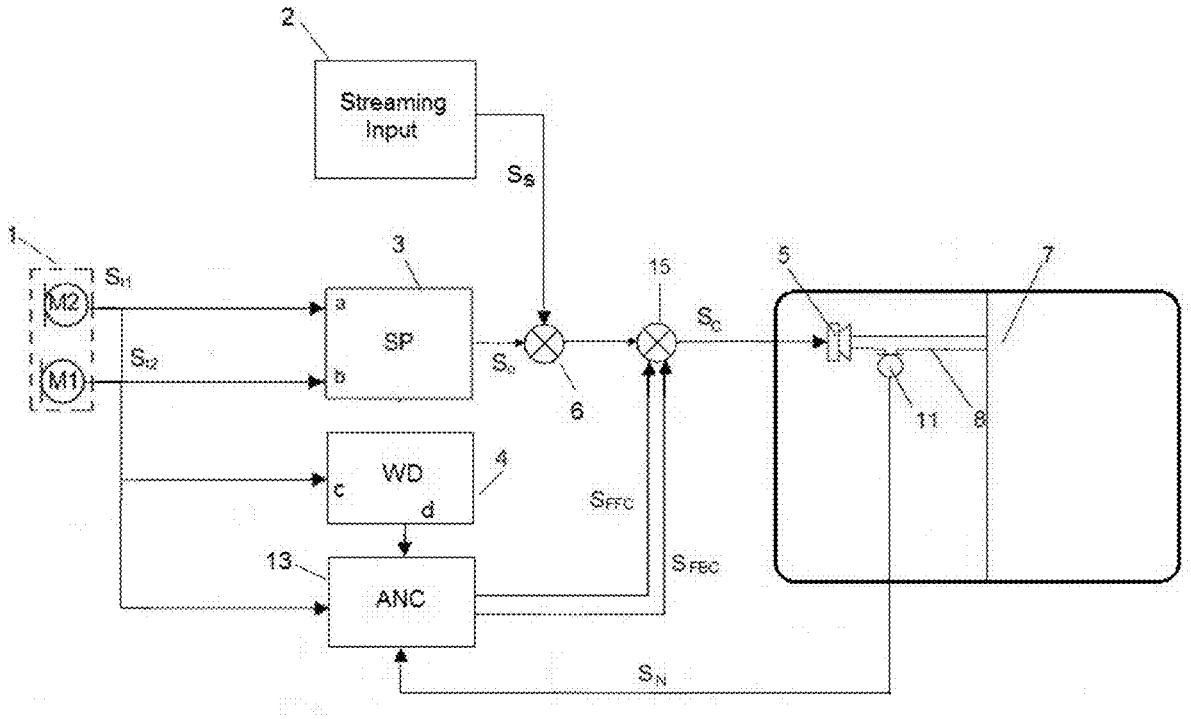
FIG. 6 is an example hearing device with a hybrid feed-forward ANC and feed-back ANC system and an exemplary wind noise detection module.

Turning now to FIG. 6, which illustrates an example hearing device with an a hybrid feed-forward ANC and feed-back ANC system and an exemplary wind noise detection module, the determined wind noise level can be sent from the wind noise detector ("WD") 4 to the ANC circuitry 13. The determined wind noise presence or level can be used by the ANC circuitry 13 to selectively provide and/or adjust the feed-forward (FF) compensating signal $S_{FFC}$ and/or the feed-back (FB) compensation signal $S_{FBC}$ of the ANC circuitry 13 based on the detected wind presence and/or wind noise level.

For example, signal processing parameters, such as filter coefficients of the adaptive filter, which may be stored in advance in the memory of the signal processor 3 or in a separate memory of the compensation controller 13, if the compensation controller 13 is provided as a separate signal processor, can be used by the signal processor 3 or by the compensation controller 13 to activate the feed-forward or feed-back ANC compensation circuit, or to adjust the feed-forward and feed-back ANC compensation signals $S_{FFC}$ and $S_{FBC}$, for example.

In one embodiment, when wind noise is detected by the wind noise detector ("WD") 4, the feed-forward compensation signal $S_{FFC}$ may be turned off and the ANC compensation controller 13 may be configured to provide only the feed-back compensation signal $S_{FBC}$.

In another embodiment, when wind noise is present, the level of the feed-forward compensation signal $S_{FFC}$ may be substantially turned off. The term "substantially turned off" in this context means reducing the level of the feed-forward compensation signal $S_{FF}$c to a low enough level at which the feed-forward compensation signal $S_{FFC}$ does not make a contribution perceptible to the user.

In some embodiments, the ANC compensation controller 13 can be configured to make an adjustment to the feed-forward compensation signal $S_{FFC}$ in response to receiving an external control signal from the wind detector ("WD") 4, indicating that wind noise or a certain level of wind noise has been detected.

In one embodiment, when wind noise is present, the level of the feed-forward compensation signal $S_{FFC}$ may be reduced below a predetermined level. The predetermined level of the feed-forward compensation signal $S_{FFC}$ may be stored in advance in the memory of the signal processor 3 or in a separate memory of the compensation controller 13, if the compensation controller 13 is provided as a separate signal processor.

In another embodiment, when wind noise is present, the level of the feed-forward compensation signal $S_{FFC}$ may be substantially reduced. The term "substantially reduced" in this context means reducing the level of the feed-forward compensation signal $S_{FFC}$ to a level at which the performance of the FF-ANC path of the ANC system is still operational, but not detrimental, i.e., the feed-forward compensation signal $S_{FFC}$ continues to reduce the ambient noise and does not amplify the wind noise.

Figure 7:
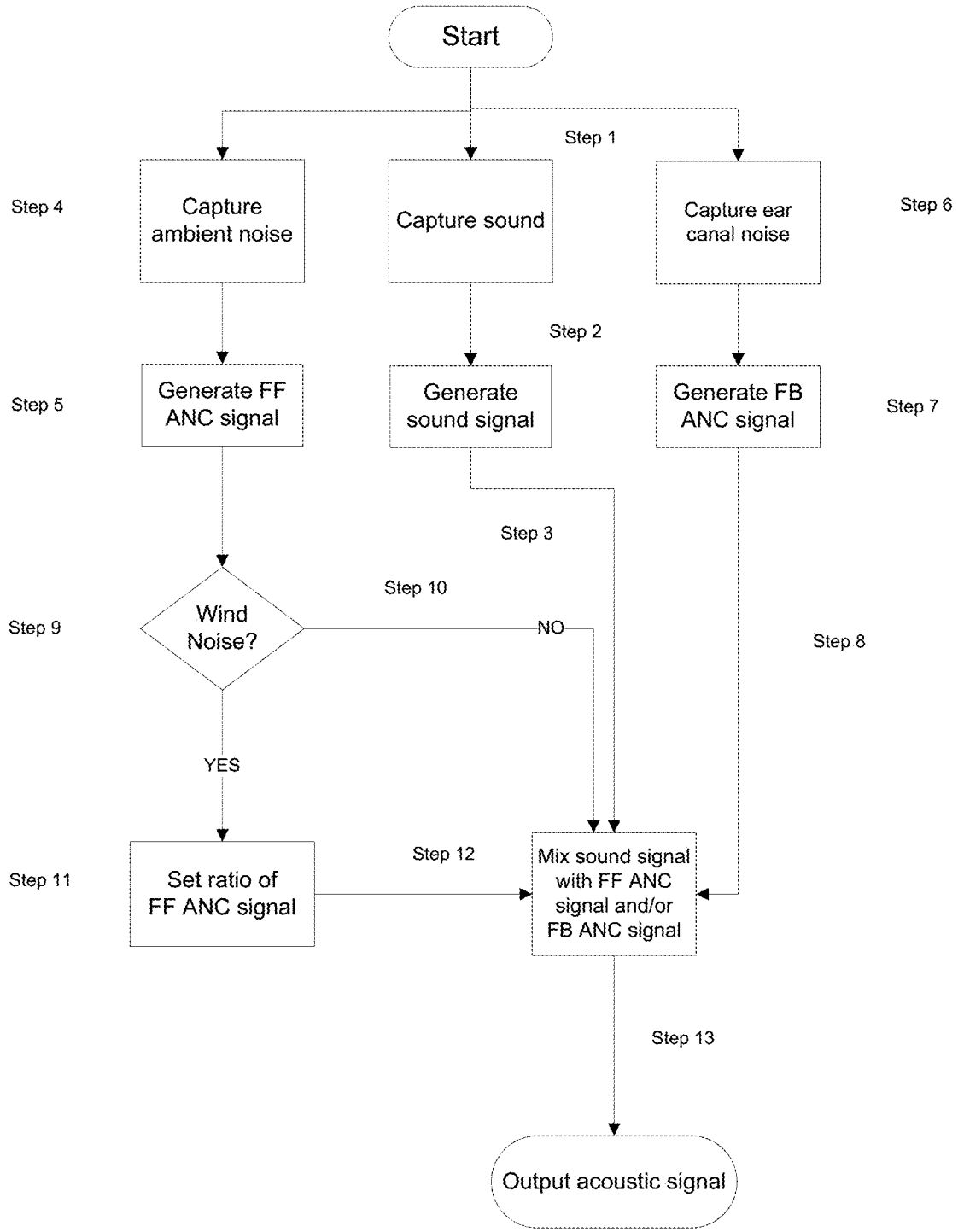
FIG. 7 is a flowchart illustrating a method for operating a hearing device with a hybrid feed-forward ANC and feed-back ANC system in a windy environment.

FIG. 7 is a flowchart illustrating a method for operating a hearing device comprising with an active noise control (ANC) system in windy environments. The numbering of the steps in FIG. 7 does not necessarily represent the order of the steps. As shown in FIG. 7, some of the steps may be performed in a different order or in parallel, for example. As illustrated in FIG. 7, the method begins when sound is captured with a microphone system 1. As described above, the microphone system 1 can include two microphones M1 and M2, for example. At Step 1, capturing audio includes capturing sound that a user may desire to hear. At Step 2, a sound signal is generated from the captured sound. For example, the generated sound signal can be the electrical output signal $S_O$ from the input microphone 1 processed by the signal processor 3, as illustrated and described with reference to FIGS. 3-6 above. In Step 3, the generated sound signal is provided as input to the mixer 15, where it may be mixed with the generated feed-forward (FF) compensating signal and/or with the generated feed-back (FB) compensating signal as discussed below for Steps 8, 10, and 12.

At Step 4, capturing audio includes the input microphone system 1 capturing ambient noise. At Step 5, the ANC compensation controller 13 generates a feed-forward (FF) compensating signal based on the ambient noise.

At Step 6, an ear noise microphone 11 captures an ear-canal noise. At Step 7, when ear-canal noise is detected by the ear noise microphone 11, the ANC compensation controller 13 generates a feed-back (FB) compensating signal.

In Step 8, the generated a feed-back (FB) compensating signal is mixed with the electrical output signal $S_O$ from the input microphone 1 processed by the signal processor 3, and, in Step 13, the resulting compensated signal is provided as an acoustic output signal to the receiver 5 which can broadcast the resulting compensated signal into the user's ear canal, thereby substantially canceling the noise from the ear noise microphone 11.

At Step 9, the wind noise detector ("WD") 4 monitors the acoustic environment of the hearing device for presence of wind noise. At Step 10, if the wind noise detector ("WD") 4 does not detect the presence of wind noise (path "NO"), the wind noise detector ("WD") 4 can send a control signal to the ANC compensation controller 13 and to the signal processor 3 to send the electrical output signal $S_O$ from the input microphone 1 and the generated feed-forward (FF) compensating signal (without reduction, adjustment, or weighting), respectively, to the mixer 15 (shown in FIGS. 3-6) where the electrical output signal $S_O$ and the generated feed-forward (FF) compensating signal can be mixed to produce a compensated output signal $S_C$.

At Step 11, when the wind noise detector ("WD") 4 detects the presence of wind noise (path "YES"), the wind noise detector ("WD") 4 sends a control signal to the ANC compensation controller 13 to set a ratio of the feed-forward (FF) compensating signal to the sound signal. The ratio of the feed-forward (FF) compensating signal to the sound signal can be set depending on whether wind noise is detected. The ratio of the feed-forward (FF) compensating signal to the sound signal can be set by the ANC compensation controller 13 (by setting the output level) or by the mixer 15 (by weighting some or all of the input signals from the ANC compensation controller 13 and the signal processor 3).

When the ratio of the feed-forward (FF) compensating signal to the sound signal is set by the ANC compensation controller 13, the ANC compensation controller 13 can set the output level of (e.g., adjust) the feed-forward (FF) compensating signal before the feed-forward (FF) compensating signal is mixed with the electrical output signal $S_O$ from the input microphone 1 (as described with reference to Step 13 below). The output level of the feed-forward (FF) compensating signal can vary depending on how much wind noise is detected by the wind noise detector ("WD") 4. For example, the ANC compensation controller 13 can reduce the output level of the feed-forward (FF) compensating signal before mixing the feed-forward (FF) compensating signal with the electrical output signal $S_O$ from the input microphone 1. Alternatively, the wind noise detector ("WD") 4 can send a control signal to the ANC compensation controller 13 to set the ratio of the feed-forward (FF) compensating signal to the sound signal by turning off (that is by not generating at all) the feed-forward (FF) compensating signal. For example, the ANC system can be simplified by turning off feed-forward (FF) compensating signal completely, as opposed to reducing the feed-forward (FF) compensating signal below a threshold, as described with reference to Step 11 below.

Alternatively, the ratio of the feed-forward (FF) compensating signal to the sound signal can be set by the mixer 15. For example, in Step 11, the mixer 15 can weight the feed-forward (FF) compensating signal generated by the ANC compensation controller 13 relative to the audio signal in proportion to the captured sound signal, the detected wind noise, the desired ambient noise reduction, and the desired wind noise reduction, for example. In Step 12, the mixer 15 can then mix the electrical output signal $S_O$ from the input microphone 1 with the weighted feed-forward (FF) compensating signal and/or with the generated feed-back (FB) compensating signal.

At Step 13, the mixer 15 can output the resulting mixed compensated signal $S_C$ as an acoustic output signal to the receiver 5 which can broadcast the resulting compensated signal into the user's ear canal. At Step 11, when the ratio of the feed-forward (FF) compensating signal to the sound signal is set by the ANC compensation controller 13, the ANC compensation controller 13 can reduce the output level of the feed-forward (FF) compensating signal when the wind noise detector detects the presence of wind noise. The ANC compensation controller 13 can periodically check whether the output level of the reduced feed-forward (FF) compensating signal is below a predetermined threshold FF $ANC_{Max}$, for example. One or more predetermined thresholds FF $ANC_{Max}$ for the output level of the feed-forward compensation signal $S_{FFC}$ may be stored in advance in the memory of the signal processor 3 or in a separate memory of the compensation controller 13, if the compensation controller 13 is provided as a separate signal processor. For example, the predetermined threshold FF $ANC_{Max}$ for the output level of the feed-forward compensation signal $S_{FFC}$ can correspond to a level at which the performance of the FF-ANC path of the ANC system is still operational, but not detrimental, i.e., the feed-forward compensation signal $S_{FFC}$ continues to reduce the ambient noise and does not amplify the wind noise. Alternatively, at Step 9, the wind noise detector ("WD") 4 can send a control signal to the ANC compensation controller 13 to turn off the feed-forward (FF) compensating signal to set the ratio of the feed-forward (FF) compensating signal to the sound signal by turning off (that is by not generating at all) the feed-forward (FF) compensating signal. For example, the ANC system can be simplified by turning off feed-forward (FF) compensating signal completely, as opposed to reducing the output level of the feed-forward (FF) compensating signal below the threshold FF $ANC_{Max}$. In certain situations, the ANC compensation controller 13 can set the ratio of the feed-forward (FF) compensating signal to the sound signal to be zero (i.e., no feed-forward (FF) compensating signal will be mixed with the electrical output signal $S_O$). This may be done, for example, by setting the output level of the FF compensating signal from the ANC compensation controller 13 to zero. Alternatively, the ANC compensation controller 13 can set the output level of the FF compensating signal to zero by not generating an FF compensating signal (i.e., no feed-forward (FF) compensating signal will be mixed with the electrical output signal $S_e$).

If the output level of the reduced feed-forward (FF) compensating signal is not below the predetermined threshold FF $ANC_{Max}$, the ANC compensation controller 13 can continue to reduce the feed-forward (FF) compensating signal.

If the output level of the reduced feed-forward (FF) compensating signal is below the predetermined threshold FF $ANC_{Max}$, in Step 12, the reduced feed-forward (FF) compensating signal can be mixed, at the mixer 15, with the electrical output signal $S_O$ from the input microphone 1 processed by the signal processor 3 and/or with the generated feed-back (FB) compensating signal, and, in Step 13, the resulting compensated signal can be provided as an acoustic output signal to the receiver 5 which can broadcast the resulting compensated signal into the user's ear canal, thereby substantially canceling the noise from the input microphone 1.

Alternatively, when at Step 11 the ratio of the feed-forward (FF) compensating signal to the sound signal is set by the mixer 15, the mixer 15 can weight the feed-forward (FF) compensating signal generated by the ANC compensation controller 13 relative to the audio signal in proportion to some or all of the input signals to the ANC compensation controller 13 and the signal processor 3, such as the captured sound signal, the detected wind noise, the desired ambient noise reduction, and the desired wind noise reduction, for example. Specifically, the FF compensating signal can be given a lower weight than the audio signal when the wind noise detector detects the presence of wind noise. In Step 12, the mixer 15 can then mix the electrical output signal $S_O$ from the input microphone 1 with the weighted feed-forward (FF) compensating signal and/or with the generated feed-back (FB) compensating signal. To effectively turn off the FF compensating signal, the mixer 15 can set the weighting of the feed-forward (FF) compensating signal generated by the ANC compensation controller 13 to be zero (i.e., no feed-forward (FF) compensating signal will be mixed with the electrical output signal $S_e$).

In Step 13, the mixer 15 can output the resulting mixed compensated signal as an acoustic output signal to the receiver 5 which can broadcast the resulting compensated signal into the user's ear canal.

Regardless whether the ratio of the feed-forward (FF) compensating signal to the sound signal is set by the ANC compensation controller 13 by setting the output level of the feed-forward (FF) compensating signal or by the mixer 15 by weighting the feed-forward (FF) compensating signal relative to the audio signal, while the output level of the generated feed-forward (FF) compensating signal is adjusted or during weighting the mixing of the generated FF compensating signal relative to the first audio signal, the ANC compensation controller 13 can continue to generate the feed-back (FB) compensating signal. In other words, the ANC compensation controller 13 continuously generates the feed-back (FB) compensating signal while the output level of the feed-forward (FF) compensating signal is being reduced or while the generated FF compensating signal is being given a lower weight than the first audio signal while the FF compensating signal is being mixed with the audio signal.

Further, the ANC compensation controller 13 can continuously generate the feed-back (FB) compensating signal without reducing the feed-back (FB) compensating signal or without giving the feed-back (FB) compensating signal a lower weight than the first audio signal while the output level of the feed-forward (FF) compensating signal is being reduced or while the generated FF compensating signal is being given a lower weight than the first audio signal while the FF compensating signal is being mixed with the audio signal.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A method for operating a hearing device comprising an active noise control (ANC) system, said method comprising:

capturing audio with a microphone system;

generating an audio signal based on the captured audio;

generating a feed-forward (FF) compensating signal based on the captured audio;

monitoring an acoustic environment of the hearing device for presence of wind noise; and mixing the audio signal with the generated FF compensating signal at a ratio of the generated FF compensating signal dependent on whether wind noise is detected to provide an acoustic output signal.

2. The method according to claim 1, wherein the microphone system comprises a first microphone configured to capture a first audio and generate a first audio signal and a second microphone configured to capture a second audio and generate a second audio signal, and wherein the monitoring the acoustic environment of the hearing device for presence of wind noise comprises:

determining a level of the wind noise based on a coherence between the first audio signal and the second audio signal.

3. The method according to claim 2, wherein a level of the coherence between the first audio signal and the second audio signal is determined between corresponding subbands of the first audio signal and the second audio signal.

4. The method according to claim 1, wherein the ratio of the mixing of the generated FF compensating signal with the audio signal is set by reducing an output level of the generated FF compensating signal.

5. The method according to claim 4, wherein the audio signal is mixed with the reduced output level of the FF compensating signal when wind is detected.

6. The method according to claim 1, wherein the ratio of the mixing of the generated FF compensating signal with the audio signal is set by weighting the mixing of the generated FF compensating signal in proportion to the detected wind noise, a desired ambient noise reduction, and a desired wind noise reduction.

7. The method according to claim 1, wherein mixing the audio signal with the generated FF compensating signal includes giving the generated FF compensating signal a lower weight than the audio signal when wind is detected.

8. The method according to claim 1, wherein the ratio of the mixing of the generated FF compensating signal with the audio signal is set by adjusting an output level of the generated FF compensating signal or by weighting the mixing of the generated FF compensating signal relative to the audio signal.

9. The method according to claim 8, wherein the adjusting the output level of the generated FF compensating signal comprises substantially reducing the output level of the FF generated compensating signal.

10. The method according to claim 8, wherein the adjusting the output level of the generated FF compensating signal comprises reducing the output level of the FF compensating signal below a predetermined threshold.

11. The method according to claim 8, wherein the adjusting the output level of the generated FF compensating signal comprises substantially turning off the FF compensating signal.

12. The method according to claim 8, wherein the adjusting the output level of the generated FF compensating signal comprises turning off the FF compensating signal.

13. The method according to claim 8, wherein the output level of the generated FF compensating signal is set to zero or the weighting of the generated FF compensating signal is set to zero.

14. The method according to claim 8, further comprising:

capturing an ear-canal noise and generating an ear-canal noise signal with an ear-canal microphone;

generating a feed-back (FB) compensating signal based on the ear-canal noise signal; and mixing the audio signal with the generated FB compensating signal to provide an acoustic output signal, wherein the FB compensating signal is continuously generated when the output level of the generated FF compensating signal is adjusted or when weighting the mixing of the generated FF compensating signal relative to the audio signal.

15. The method according to claim 14, wherein the generating the FF compensating signal and the generating the FB compensating signal comprise adaptive filtering, wherein filter parameters for the adaptive filtering are adjusted based on the audio signal and the ear-canal noise signal, respectively.

16. The method according to claim 14, wherein the monitoring the acoustic environment of the hearing device for presence of wind noise comprises:

monitoring a ratio between energy levels in low frequency bands and a total signal energy of the audio signal and the ear-canal noise signal.

17. A hearing device comprising:

a microphone system configured to capture audio;

a signal processor configured to generate an audio signal based on the captured audio;

an active noise control (ANC) system configured to generate a feed-forward (FF) compensating signal based on the captured audio;

a wind noise monitor configured to monitor an acoustic environment of the hearing device for presence of wind noise; and a mixer configured to mix the audio signal with the generated FF compensating signal at a ratio of the generated FF compensating signal dependent on whether wind noise is detected to provide an acoustic output signal.

18. The hearing device according to claim 17, wherein the ratio of the mixing of the generated FF compensating signal with the audio signal is set by adjusting an output level of the generated FF compensating signal or by weighting the mixing of the generated FF compensating signal relative to the audio signal.

19. The hearing device according to claim 17, further comprising:

an ear-canal microphone configured to capture an ear-canal noise and generate an ear-canal noise signal, wherein:

the ANC system is further configured to generate a feed-back (FB) compensating signal based on the ear-canal noise signal; and the mixer is further configured to mix the audio signal with the generated FB compensating signal to provide an acoustic output signal, wherein the ear-canal microphone is configured to be arranged inside an ear canal of a user.

20. The hearing device according to claim 17, wherein the microphone system is arranged outside an ear canal of a user.

21. A method for operating a hearing device comprising an active noise control (ANC) system, said method comprising:

capturing audio with a microphone system and generating an audio signal representing the captured audio;

generating a feed-forward (FF) compensating signal based on the captured audio;

capturing an ear-canal noise with an ear-canal microphone and generating an ear-canal noise signal representing the ear-canal noise;

generating a feed-back (FB) compensating signal based on the ear-canal noise signal;

mixing the audio signal with the generated FF compensating signal and the generated FB compensating signal to provide an acoustic output signal;

monitoring an acoustic environment of the hearing device with the microphone system for presence of wind noise;

turning off the FF compensating signal when wind is detected; and mixing the audio signal with the generated FB compensating signal to provide an acoustic output signal.

* * * * *